US007168778B2

(12) United States Patent
Baxter

(10) Patent No.: US 7,168,778 B2
(45) Date of Patent: Jan. 30, 2007

(54) PRINTHEAD CARTRIDGE

(75) Inventor: William Ronald Stuart Baxter, Cambridge (GB)

(73) Assignee: Agfa-Gevaert N.V., Mortsel (BE)

( * ) Notice: Subject to any disclaimer, the term of this patent is extended or adjusted under 35 U.S.C. 154(b) by 14 days.

(21) Appl. No.: 10/276,083

(22) PCT Filed: May 16, 2001

(86) PCT No.: PCT/EP01/05594

§ 371 (c)(1),
(2), (4) Date: Jun. 25, 2003

(87) PCT Pub. No.: WO01/87620

PCT Pub. Date: Nov. 22, 2001

(65) Prior Publication Data

US 2004/0021721 A1 Feb. 5, 2004

(30) Foreign Application Priority Data

May 17, 2000 (GB) ..... 0011916.4

(51) Int. Cl.
*B41J 29/377* (2006.01)

(52) U.S. Cl. ..... 347/18; 347/17

(58) Field of Classification Search ..... 347/18, 347/13, 12, 223, 17; 165/80.4; 361/703, 361/702

See application file for complete search history.

(56) References Cited

U.S. PATENT DOCUMENTS 4,962,444 A * 10/1990 Niggemann ..... 361/702
5,016,090 A * 5/1991 Galyon et al. ..... 257/714
5,017,941 A * 5/1991 Drake ..... 347/67
5,021,924 A * 6/1991 Kieda et al. ..... 361/699
5,023,695 A * 6/1991 Umezawa et al. ..... 257/714
5,066,964 A * 11/1991 Fukuda et al. ..... 347/18
5,270,572 A * 12/1993 Nakajima et al. ..... 257/714
5,402,160 A * 3/1995 Kadowaki et al. ..... 347/18
5,818,516 A 10/1998 Rezanka ..... 347/18
6,007,176 A * 12/1999 Askren et al. ..... 347/18
6,174,055 B1 * 1/2001 Sugikubo et al. ..... 347/89
6,280,013 B1 * 8/2001 Wade et al. ..... 347/17

FOREIGN PATENT DOCUMENTS

| | | |
|---|---|---|
| EP | 0 498 293 | 8/1992 |
| WO | WO97/36212 | 10/1997 |

* cited by examiner

*Primary Examiner*—Stephen Meier
*Assistant Examiner*—Rene Garcia, Jr.
(74) *Attorney, Agent, or Firm*—Robert A. Sabourin

(57) ABSTRACT

A printhead cartridge for a multi-printhead ink jet printer includes an array of ink jet nozzles and a heat sink for controlling the temperature of the nozzles. The heat sink is made up of a copper block and thinner copper wing regions extending from the block parallel to the array of nozzles. A passageway for coolant water is formed in the block and extends into the wings as a thinner channel. The block and the wing regions are mounted in thermal contact with the array of ink jet nozzles. The heat sink has the advantage that it allows the cartridges in the printer to be stitched together to cover the full width of a substrate.

2 Claims, 3 Drawing Sheets

PRINTHEAD CARTRIDGE

The present application is a national stage filing and claims priority under 35 U.S.C. § 119 of International patent application Serial No. PCT/EP01/05594, filed 16 May 2001, and published in English and Great Britain Serial No. 0011916.4, filed 17 May 2000, the content of which is hereby incorporated by reference in its entirety.

The present invention relates to printing and in particular to printing using a multi-printhead ink jet printer formed from a plurality of printheads and which is wide enough to print across the full width of a continuous substrate.

A multi-printhead printer may be used in so-called "drop-on-demand" ink jet printing to print on to a continuous substrate, for example to print directly onto packaging in a production line. In this case, the printer may be arranged opposite a transport mechanism for the substrate, such as a part of the production line. Such printing is particularly attractive in the production of packaging because it is possible to package items from the same production run into packaging with a different appearance without stopping the packaging line. Thus, for example, the packaging printer may print packaging in one language for the first hundred units and then switch to print packaging in a different language for the next hundred units. Alternatively, the printer may switch from printing the packaging bearing one customer's trade marks to printing those of another. In either case, it is not necessary for a continuous production line to stop for the outer packaging to be changed, and this saves time and therefore money in the production process.

A multi-printhead ink jet printer comprises a very large number of densely packed nozzles through which ink is ejected onto the printing substrate to form the printed image. The spacing between nozzles can be around 140 microns to give a pixel density of 180 dpi. It is important that the ink jet nozzles are accurately located relative to each other, as a very small misalignment of even one nozzle can produce a noticeable effect on the printed image. In order to achieve a desired print density, the ink jet nozzles may be interleaved, i.e. one row of nozzles may be arranged to print pixels between the pixels printed by a second row of nozzles.

If it is desired to print in colour, separate nozzles are provided for each of the different coloured inks and the location of these nozzles must be coordinated with the required degree of accuracy. Many different coloured inks may be used for a full colour industrial printing process, and even in simple situations several colours may be used.

A multi-printhead ink jet printer can be made up of a plurality of printheads in the form of cartridges which fit together to form the whole printer. Such printheads are available from XaarJet Limited of Cambridge, United Kingdom. Such a multi-printhead printer has the advantage that failed ink jet printheads can be replaced without replacing the whole printer. In order that the whole printer is wide enough to cover the width of a desired substrate, the printheads are "stitched" together, so that the printheads overlap in the direction perpendicular to the direction of transport of the substrate.

Thus, in a multi-printhead printer the printheads must be accurately aligned to ensure acceptable printing results. In addition, it is desirable for the printer to be relatively compact in order to fit into standard production lines.

For ink jet printing, it is important that the temperature of the ink at the ink jet nozzles is controlled carefully to ensure reliable printing. Often, the printhead is run at a temperature sufficiently higher than ambient that cooling of the nozzles is not required. In other situations, it is not possible to operate at such temperatures and some form of cooling or heating is required.

Furthermore, the temperature profile across an array of ink jet nozzles should also be relatively uniform. However, in a multi-printhead printer where the cartridges are stitched together, there is very limited space in which to locate a device that is able to regulate the temperature of all the ink jet nozzles.

The present invention seeks to provide an arrangement for the temperature control of a stitched printhead cartridge.

According to the present invention, there is provided a cartridge for a multi-printhead ink jet printer, the cartridge comprising at least one array of ink jet nozzles and a heat sink for controlling the temperature of the nozzles, wherein the heat sink comprises a block of thermally conductive material having formed therein a passageway for a thermally conductive fluid, and wing regions of thermally conductive material extending from said block substantially parallel to said array of nozzles, and wherein the block and the wing regions are in thermal contact with the array of ink jet nozzles and the wing regions have an extent in a direction perpendicular to the array of nozzles which is smaller than the extent of the block in the same direction.

In accordance with the invention, the heat sink for the printhead cartridge has thin wing regions and a thicker block. The thin wing regions allow the cartridges to be stitched while maintaining the required temperature control. The thicker block allows a connection to be made to a coolant circuit of thermally conductive fluid, and increases the overall thermal capacity of the heat sink to maintain thermal stability.

The heat sink may be made of any suitable material and in the preferred embodiment the material is copper. Similarly, the thermally conductive fluid may be any suitable fluid, and is water in the preferred embodiment.

The passageway for the thermally conductive fluid may extend into the wing regions of the heat sink, in which case the passageway may be thinner in the wing regions than in the block.

An embodiment of the invention will now be described by way of example only and with reference to the accompanying drawings in which.

Figure 1:
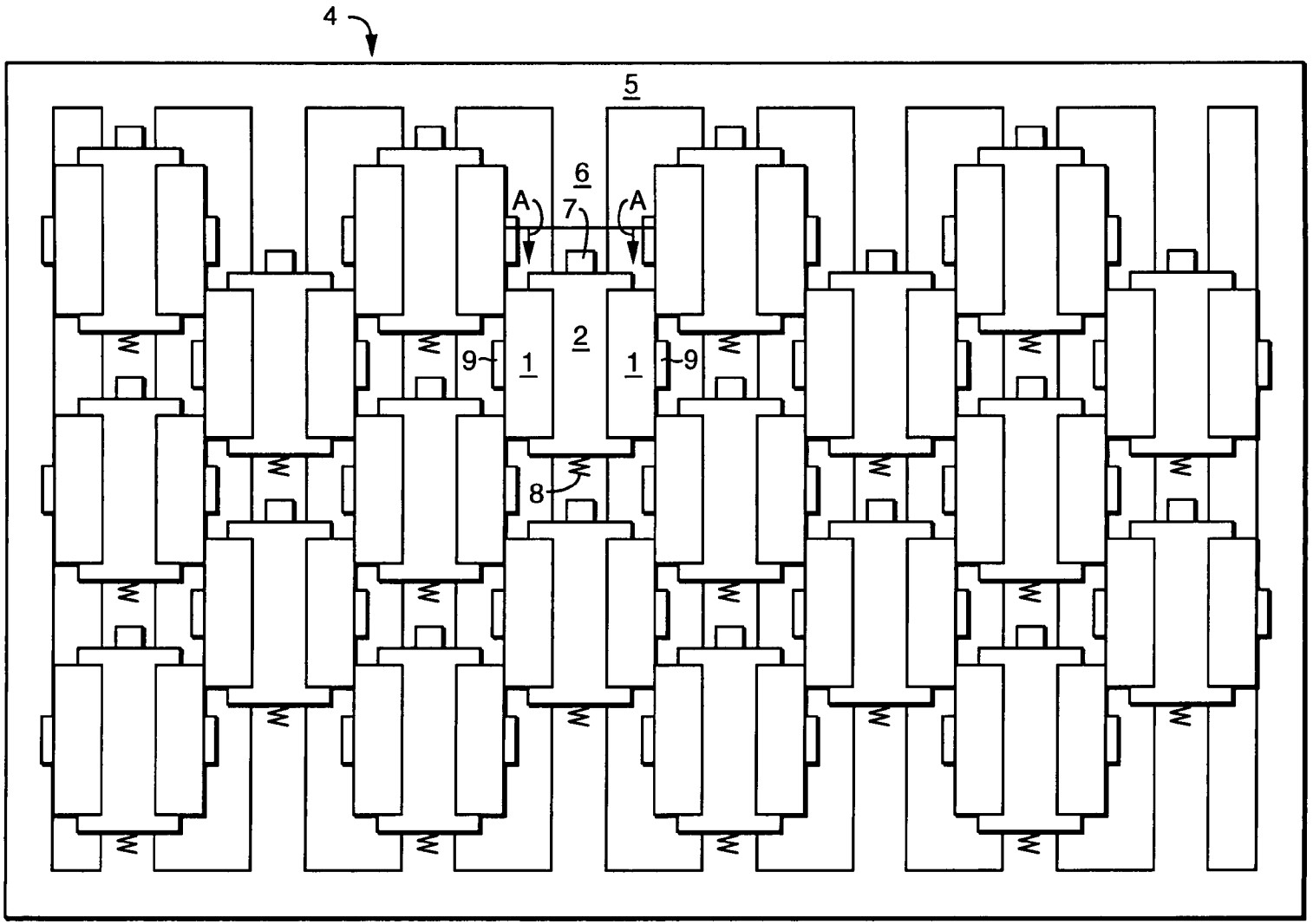
FIG. 1 shows schematically a plan view of a multi-printhead printer according to an embodiment of the invention.

FIG. 1 shows a multi-printhead printer according to an exemplary embodiment of the invention, which is intended for printing onto a continuous web of material such as paper or cardboard. The printer comprises 20 identical cartridges (shown in more detail in FIG. 2), each of which is made up of two 92 mm on wide printheads 1 mounted to a common support 2. Each printhead 1 comprises a 70 mm wide array 3 of 500 ink jet nozzles at its lowermost end, and contains an arrangement of miniature valves for controlling the ejection of ink through the nozzles. An ink supply (not shown) is connected to the printhead 2 at its upper end. The array 3 of ink jet nozzles on each printhead 1 has an effective printing density of 180 dpi. The two printheads 1 are interleaved on the support 2 such that the nozzles of the array 3 of one printhead are offset relative to the nozzles of the array 3 of the other printhead by half the distance between adjacent nozzles. In this way, one printhead 1 is able to print pixels between the pixels printed by the other printhead 1. This gives an effective print density for the whole cartridge of 360 dpi.

The printer comprises a chassis 4, to which each cartridge is mounted in a precise location. The chassis 4 comprises an outer, rectangular frame 5 across which run a plurality of horizontal bars 6 to which the cartridges are mounted. The bars 6 are perpendicular to the direction of movement of the substrate (the z-direction) when the printer is in the position of use. On each bar 6, adjacent the location of each cartridge is provided a stop 7 which limits the movement of the cartridge in the direction along the bar 6 (the x-direction). The support 2 of each cartridge is urged against the respective stop 7 by a resilient member 8 represented schematically in FIG. 1 by a spring.

Figure 2:
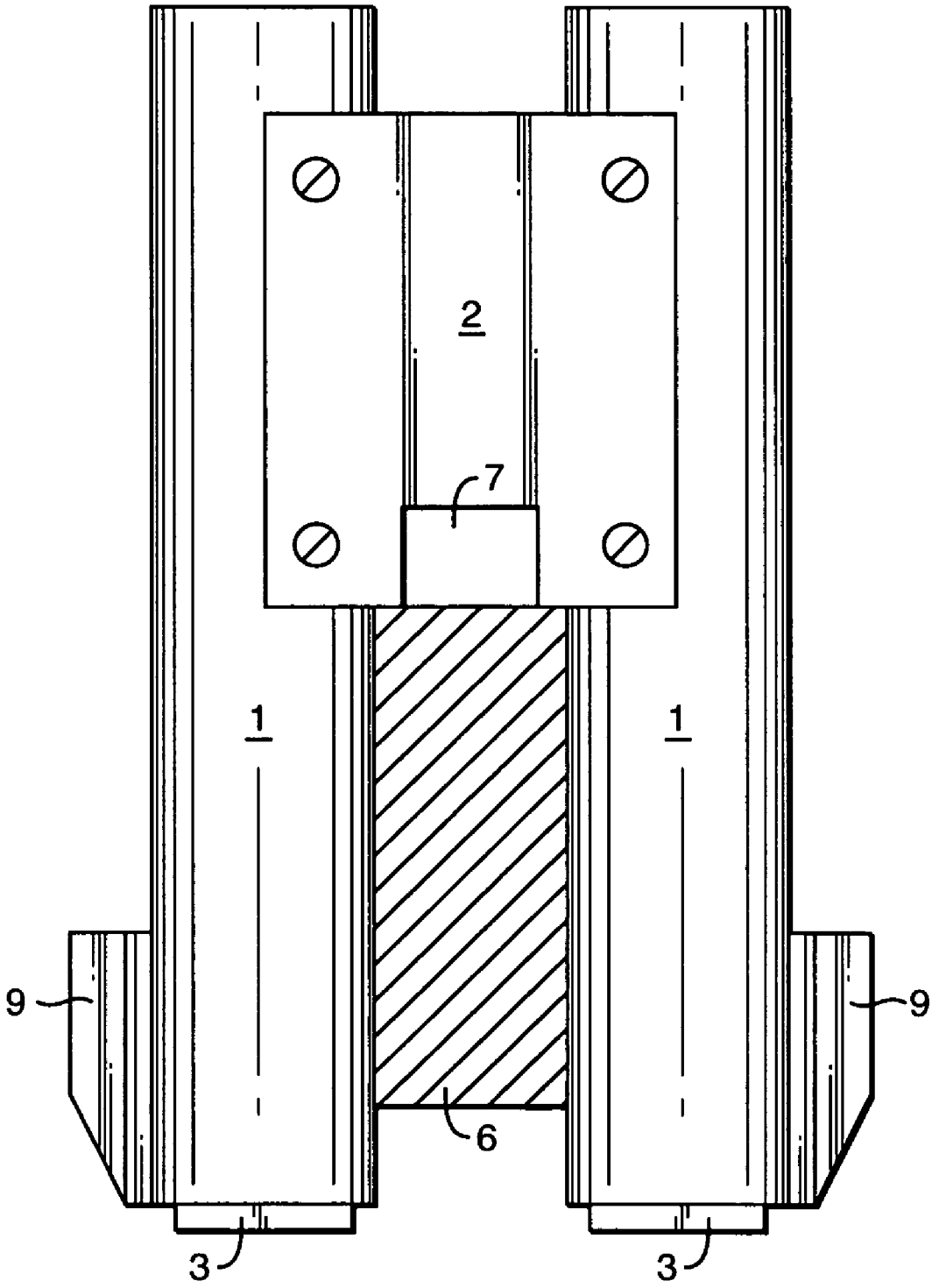
FIG. 2 shows schematically an enlarged elevation of a single cartridge of the printer of FIG. 1 viewed in cross-section along the line A—A of FIG. 1.

As shown most clearly in FIG. 2, each cartridge straddles a bar 6, with one printhead 1 on either side of the bar 6. The lower surface of the support 2 engages with the upper surface of the bar 6 to locate the cartridge in the direction perpendicular to the surface of the substrate (the y-direction) and the inner surface of one printhead engages with a lateral surface of the bar 6 to locate the cartridge in the z-direction.

In order for printing to be possible across the full width of the printer, adjacent rows of cartridges are "stitched", i.e. arranged with an overlap in the x-direction. The overlap allows the whole width of the substrate to be covered continuously by the ink jet nozzles even though the width of the printheads 1 is greater than the width of the array 3 of ink jet nozzles that they carry.

The arrangement of cartridges shown in FIG. 1 is intended for four-colour (yellow, magenta, cyan, black) printing with a respective row of three cartridges stitched with the adjacent row of two cartridges for each colour. Thus, the four colours are printed by respective rows of cartridges sequentially in the z-direction. For printing with a greater number of colours, it is necessary only to increase the number of rows of cartridges. To increase the width of the printing, it is necessary to increase the number of cartridges in each row.

In order for the ink jet nozzles 3 to operate correctly their temperature must be carefully controlled. The temperature of the nozzles 3 is controlled by a respective heat sink 9 provided in thermal contact with the outer surface of each of the printheads 1.

Figure 3A:
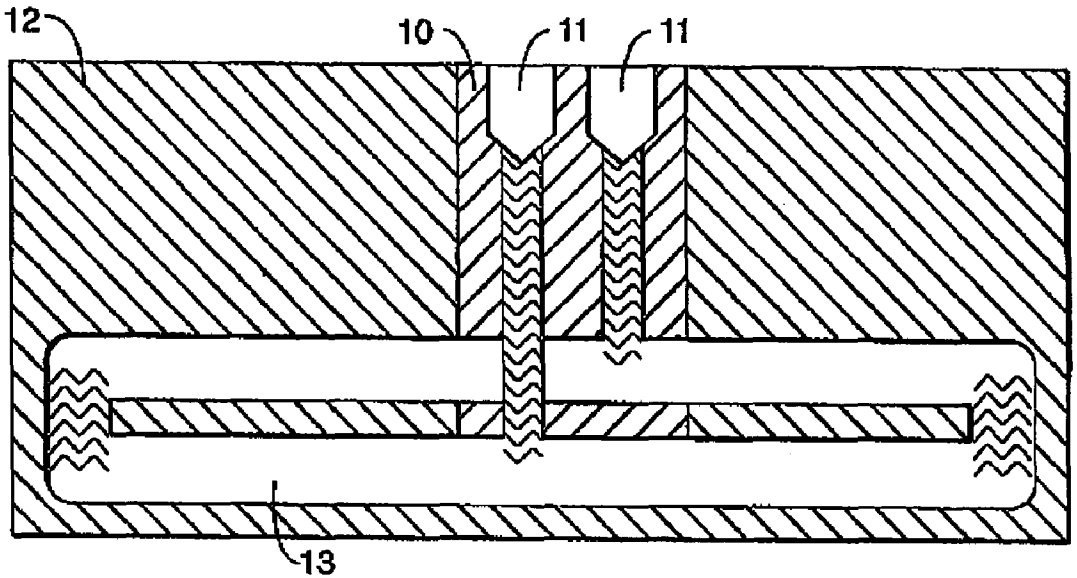
FIGS. 3*a, b* shows schematically the heat sink of the cartridge of FIG. 2 in elevation (FIG. 3*a*) and plan (FIG. 3*b*) views.
Figure 3B:
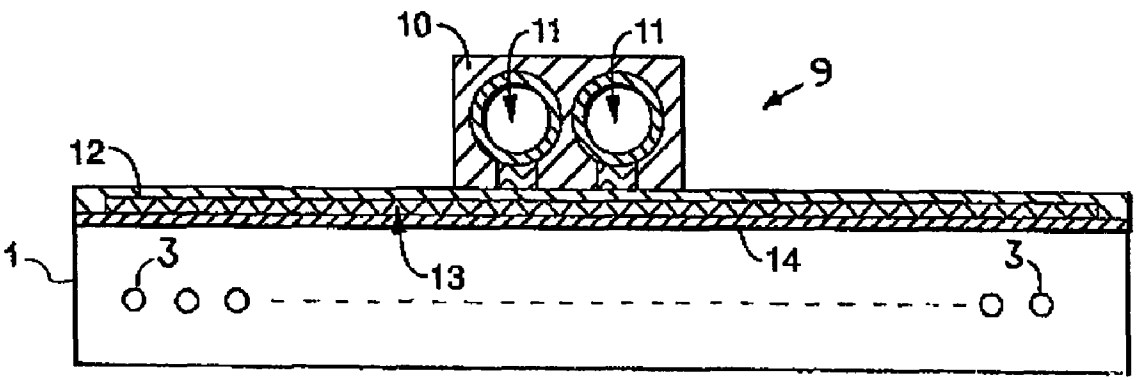

Referring to FIG. 3, the heat sink 9 is made from commercial grade copper and comprises a 18×30 mm solid block 10 which extends 10 mm from the back surface of the heat sink 9, and in which are formed two tapped 15 holes 11 for the connection of a coolant water supply (not shown). The block 10 is formed integrally with a 70×30 mm bottom plate 12 which has milled therein a channel 13 which defines a relatively flat fluid passageway of cross-section 10×1.2 mm. The total thickness of the bottom plate is 2.5 mm and it is the bottom plate that forms the thin wing regions of the heat sink 9 on either side of the block 10.

The channel 13 is closed by a back plate 14 which is soldered to the bottom plate 12. The bottom plate 12 is detailed such that it can be soldered to the back plate 14 with plumbing solder to form an effective water seal around the channel 13. During the soldering operation great care is taken to ensure the flatness of the bottom plate 12 is maintained, so that good thermal contact can be made with the array 3 of nozzles, when the heat sink 9 is fitted with the closed end of the fluid pathway flush with the backplate of the printhead 1, which is in itself in good thermal contact with the nozzle array 3.

The channel 13 is in fluid communication with the holes 11 in the block so that coolant water can circulate therethrough to remove heat from the array 3 of nozzles. The lead-in to the tapped holes 11 is such that the flow is not greatly impaired compared with the channel 13. The cold side of the coolant water is fed directly to the end of the channel 13 with a fluid pathway that passes over the warm return path.

The heat sink is supplied with 2.6 litres/minute of water at the minimum operating temperature for the ink and at a pressure of greater than 1 bar. It has been calculated that the maximum heat sink temperature, at the end of the thin wings regions, is approximately 5° C. higher than the water temperature, assuming a required thermal dissipation of 40 W. In practice, the measured temperature difference has been found to be even smaller than the calculated value, which is based on pessimistic assumptions.

As can be seen from FIG. 1, the heat sink 9 according to the invention allows the cartridges to be stitched to cover the entire width of the substrate. Nevertheless, the heat sink ensures that the temperature of the array 3 of nozzles is accurately controlled.

In summary, a printhead cartridge for a multi-printhead ink jet printer includes an array 3 of ink jet nozzles and a heat sink 9 for controlling the temperature of the nozzles 3. The heat sink 9 is made up of a copper block 10 and thinner copper wing regions 12 extending from the block 10 parallel to the array 3 of nozzles. A passageway 11 for coolant water is formed in the block 10 and extends into the wings 12 as a thinner channel 13. The block 10 and the wing regions 12 are mounted in thermal contact with the array 3 of ink jet nozzles. The heat sink 9 has the advantage that it allows the cartridges in the printer to be stitched together to cover the full width of a substrate.

The invention claimed is:

1. A printhead cartridge for a multi-printhead ink jet printer, the cartridge comprising:

an array of ink jet nozzles for ejection of an ink through the array of ink jet nozzles; and a heat sink for controlling a temperature of the array of ink jet nozzles, wherein the heat sink comprises a block of thermally conductive material in thermal contact with the array of ink jet nozzles and having formed therein a passageway for a thermally conductive fluid, the thermally conductive fluid being different from the ink, and a wing region of thermally conductive material in thermal contact with the array of ink jet nozzles, the wing region extending from the block substantially parallel to the array of ink jet nozzles and having a channel connected to the passageway of the block for circulating the thermally conductive fluid;

wherein the wing region extends from opposite sides of the block substantially parallel to the array of ink jet nozzles, and has an extension in a direction perpendicular to the array of nozzles which is smaller than an extension of the block in a same direction; and the channel in the wing region extends from opposite sides of the block and has a supply path for supplying the thermally conductive fluid along the array of ink jet nozzles and a return path for returning the thermally conductive fluid along the array of ink jet nozzles.

2. A cartridge as claimed in claim 1, wherein the passageway in the block is thicker than the channel in the wing region.

* * * * *